United States Patent [19]

Bubley et al.

[11] Patent Number: 4,958,559

[45] Date of Patent: Sep. 25, 1990

[54] CYLINDER PRESS DRIVE ASSEMBLY

[75] Inventors: Henry J. Bubley, Deerfield, Ill.; Joseph Glotzbach, Chanute, Kans.; Phil Motev, Deerfield, Ill.

[73] Assignee: American Screen Printing Company, Chicago, Ill.

[21] Appl. No.: 253,122

[22] Filed: Oct. 4, 1988

[51] Int. Cl.[5] ..... B41L 13/16

[52] U.S. Cl. ..... 101/123

[58] Field of Search ..... 101/114, 115, 116, 122, 101/123, 124, 126

[56] References Cited

U.S. PATENT DOCUMENTS

| | | | |
|---|---|---|---|
| 3,810,422 | 5/1974 | Kammann | 101/124 |
| 3,915,088 | 10/1975 | Svantesson et al. | 101/124 |
| 3,941,053 | 3/1976 | Black et al. | 101/124 |
| 3,973,489 | 8/1976 | Black | 101/115 |
| 3,973,493 | 8/1976 | Black et al. | 101/126 |
| 4,304,180 | 12/1981 | Lala et al. | 101/126 |
| 4,498,386 | 2/1985 | Rouly et al. | 101/126 |
| 4,524,687 | 6/1985 | Bubley | 101/123 |
| 4,592,277 | 6/1986 | Dennesen | 101/126 |
| 4,724,760 | 2/1988 | Bubley | 101/115 |

FOREIGN PATENT DOCUMENTS

| | | | |
|---|---|---|---|
| 2043823 | 3/1972 | Fed. Rep. of Germany | 101/126 |
| 2001627 | 8/1980 | Fed. Rep. of Germany | 101/126 |

*Primary Examiner*—Eugene H. Eickholt

*Attorney, Agent, or Firm*—Fitch, Even, Tabin & Flannery

[57] ABSTRACT

In a screen printing cylinder press, the combination comprises:

a cylinder having a gripper thereon to grip a sheet, a screen printer including a movable screen printing carriage for applying ink to the sheet on the cylinder;

a lever connected to the cylinder and screen printing carriage to move the same through a stroke of given length;

a cam having a predetermined profiled cam surface and a cam follower for following the cam surface and connected to the lever to actuate the lever to rotate the cylinder and to reciprocate the screen printing carriage; and adjustable stroke device in said lever for adjusting the stroke of the lever from a given length of stroke, thereby changing the length amount of rotation of the cylinder and the travel of the screen printing carriage.

6 Claims, 3 Drawing Sheets

CYLINDER PRESS DRIVE ASSEMBLY

BACKGROUND OF THE INVENTION

1. Field of the Invention

This invention relates to screen printing, cylinder presses and more particularly, to drive mechanisms for driving a screen printing cylinder press.

2. Description of The Prior Art

U.S. Pat. No. 3,915,088 discloses a commonly-used drive for such screen printing, cylinder presses. This drive includes a rotating crank mechanism which is driven by a motor with the crank mechanism providing a drive for a lever subassembly, which turns a gear segment to rotate a gear connected to the cylinder A screen printing carriage has a rack which is driven by the gear on the cylinder to reciprocate the carriage with oscillation of the cylinder. A particular problem with the crank drive is that it provides a harmonic motion with a substantially equal percentage of the time being used for acceleration of the cylinder and screen printing carriage and for the deceleration thereof prior to reversing the direction of travel of the cylinder and screen printing carriage To change the direction of cylinder rotation and carriage travel requires overcoming considerable inertia. When this inertia is not smoothly overcome, there may be a banging or other hitting as the cylinder reverses its direction of rotation which may cause the screen not to be properly registered with respect to a prior image or to specific spot on the web.

With a crank as in U.S. Pat. No. 3,915,088 or with a conventional cam used to drive a cylinder or web press, little has been accomplished in controlling the inertia of the cylinder and the time period for deceleration of the cylinder and the traveling printing screen carriage.

The present invention is directed to providing lower inertia and a greater time period for slowing down and stopping the travel of the cylinder and screen printing carriage in cylinder presses.

To these ends, the present invention is directed to providing a controlled inertia with a profiled cam drive for cylinder screen printing presses in which the inertia is calculated and is controlled by minimizing the velocity, particularly when stopping the movement of the cylinder and screen printing carriage in one direction and just prior to reversing their directions of travel in the opposite directions. This is achieved by providing a faster acceleration from a stopped position over a shorter period of time than with a crank and then, providing for a much longer time and a much slower movement than with a crank, resulting in a reduced inertia for the travel of the cylinder and printing carriage when they are nearing the end of their travel in one direction.

U.S. Pat. No. 3,915,088 discloses an adjustable stroke mechanism whereby the length of the stroke provided by the drive may be easily adjusted to change the amount of rotary movement of cylinder. However, such adjustment is rather cumbersome. The present invention provides an improved stroke adjustment mechanism for cylinder presses.

Accordingly, a general object of the present invention is to provide a new and improved drive for cylinder screen printing presses.

Another and more specific object of the invention is to provide an improved drive having improved inertia and displacement characteristics relative to the harmonic accelerations and decelerations from a crank drive.

Another object of the invention is to provide the drive mechanism with a new and improved stroke adjustment mechanism for cylinder screen printing presses.

DETAILED DESCRIPTION OF THE INVENTION

These and other objects and advantages of the invention will become apparent when the following detailed description taken in which.

Figure 1:
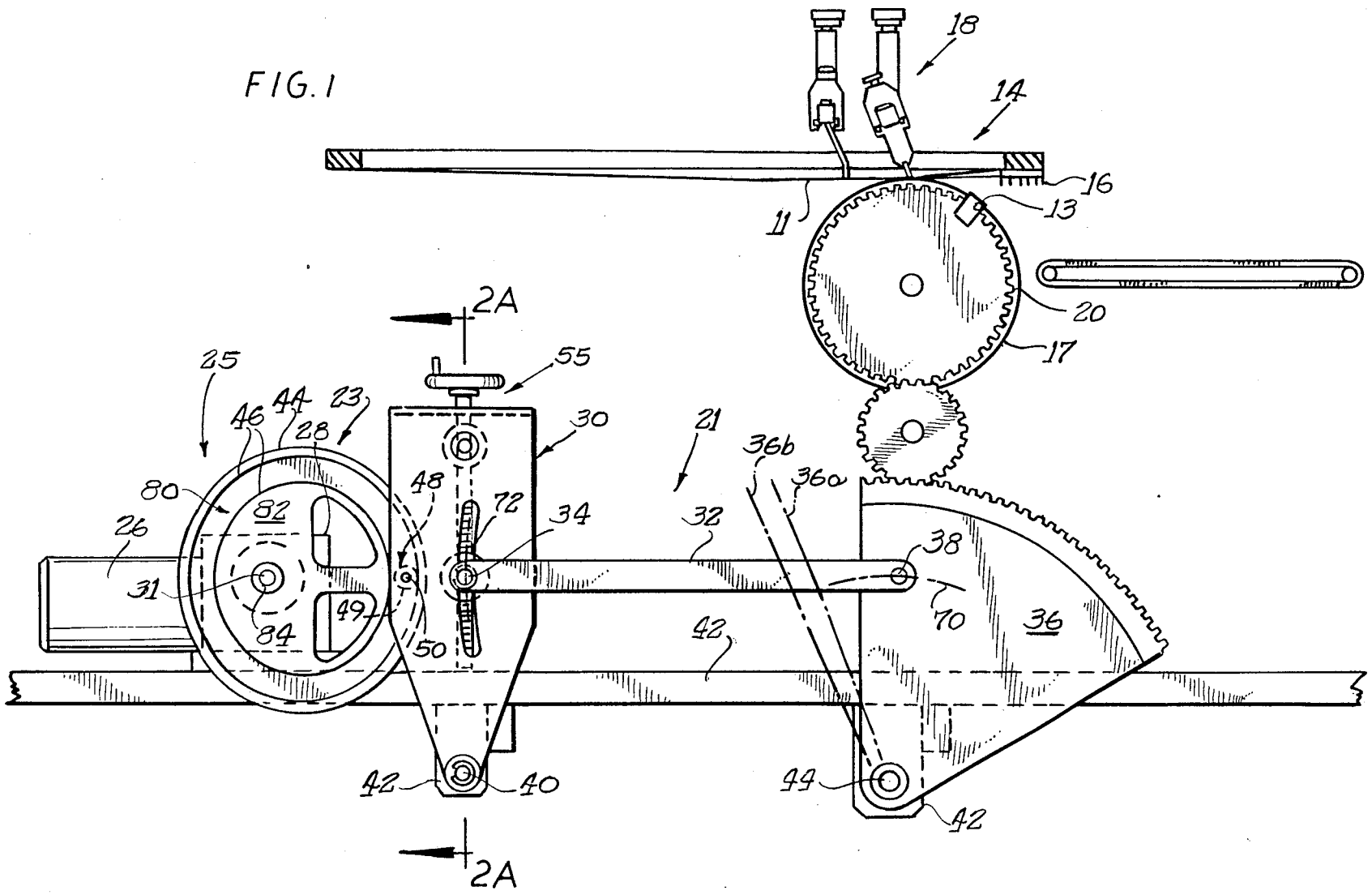
FIG. 1 is a diagrammatic view of a drive for a web press and embodying the adjustable features and controlled inertia characteristics for the screen printing carriage of the invention.

As shown in the drawings for purposes of illustration, the invention is embodied in a cylinder printing press which may be of various types, some of which are for example, shown in U.S. Pat. No. 3,915,088. A sheet 11 to be printed gripped by a gripper 13 on a rotating cylinder 17. A screen printing carriage 14 having a screen is located above the sheet and is arranged for rectilinear, reciprocating travel tangentially along the cylinder periphery in response to cylinder rotation. As shown, the printing carriage has rack 16 meshed with a gear 20 on the cylinder to assure timed movement of each. A squeegee blade means 18 usually having a flood bear and a squeegee is disposed above the screen to force ink onto the sheet as the cylinder rotates and the screen translates beneath the squeegee blade during a printing operation. On a return stroke the squeegee blade is raised and a flood bar is lowered to spread ink for the next printing operation.

A drive means for moving the screen printing carriage 14 and for rotating the cylinder 17 includes a motor and cam drive means for actuating a lever means 21 which is connected to a cam drive means 23 which is driven by a motor drive unit 25. Herein, the motor drive unit includes an electric motor 26 connected by a suitable transmission (not shown) to gear reducer 28 having an output shaft 31 driving the rotating cam means 23 which oscillates the lever means 21 which has a gear segment 36 to rotate a pinion gear 27 which is meshed with a pinion gear which in turn is meshed with gear 20 fastened to the cylinder to oscillate the same. Herein, the illustrated lever means includes a first lever 30 which is driven by the cam drive means and in turn drives a push rod 32 connected at a pivot pin means 34 to the first lever. The push rod 32 is connected at its opposite end to the gear segment 36 at a pivot pin connection 38. The first lever 30 is generally vertically disposed and is pivoted for arcuate movement about a lower pivot pin 40 fastened to a stationary frame member 42. A similar pivot pin 44 pivotally mounts the lower end of the gear segment 36 to the stationary, horizontal frame member 42 for pivoting about the axis of pivot pin. The lever 30 and gear segment 36 are generally parallel and are generally upright and have a limited oscillatory movement. The extent of oscillatory movement being illustrated in FIG. 1 between the solid right hand position shown in FIG. 1 and a dotted left hand position showing the gear segment's position at the end of the printing travel.

In some instances, where it is not desired to provide the controlled inertia characteristics above-described and to be described further below, a crank may be used to directly oscillate the first lever 30 with the usual harmonic motion in the conventional manner of the prior art such as shown for example, in U.S. Pat. No. 3,915,088. Herein, the cam means 23 includes a rotating steel cam body 44 which is generally circular and has a cam profiled surface 46 which is engaged and followed by a cam follower 48. Herein, the cam follower 48 includes a roller 49 which is mounted on a stub shaft 50 which extends horizontally and is fastened to the first lever 30 generally adjacent to the midpoint of that of the first lever. Thus, as the cam follower 48 is displaced by the profiled cam surface 46, the lever 30 will be oscillated and displaced to push the push rod 32 and pivot the gear segment 36.

In accordance with the present invention, there is provided a new and improved stroke adjusting means 55 which allows the adjustment of the printing stroke so as to provide the ability to limit the stroke of the cylinder 17 to that desired. This adjustment may be made easily and with infinitely fine adjustment by turning a threaded screw 60 preferably in the form of an Acme screw 60 which is driven by a drive means such as a handle 62 fixed to the top end of the screw. The screw extends through a threaded block 64 mounted in a banana-shaped slot 65 in the first lever 30. By turning the handle 62 and the screw thread 60 in one direction, the block 64, which is guided in guide slot 65 in the lever by slideways 68, moves vertically downward to move the pivot pin 34 which is mounted on the block 64 downwardly to vary the throw or the displacement of the push rod 32 and the gear segment 36. The banana slot 65 is an elongated opening through the first lever 30 and it is made on an arc having a radius at about the center of the pivot pin 38 for the push rod 32 so that the oscillation of the point 38 remains on the same arc 70 and the movement of the pin 34 remains on the same arc 72. Herein, the Acme screw 60 is mounted for rotational movement by stationary bearing blocks 67 and 69 at the upper and lower ends of the slot 65. The threaded block 64 is in the nature of a nut and it translates along the slot as the screw is turned. While a manual handle 62 is illustrated to turn the screw, a motor drive may be substituted for the handle to provide a remote drive for the screw. Also, an elongated, manually turned shaft could be provided to extend from the manual handle to a remote location near the press operator, if so desired.

The increment of adjustment made is not at the print beginning position but is at the end of the printing which is at the left side of FIG. 1 which is at the terminal portion, as shown by the phantom line **36*a* in FIG. 1 showing the leftmost position that the gear segment 36 may reach before the gear segment reverses its direction of travel. If the stroke adjustment means is used to shorten the stroke, then the gear segment 36 may be at the phantom position 36*b* for a shorter stroke than the position 36*a***.

In accordance with another important aspect of the present invention, the illustrated cam 44 is a captive cam including preferably a captive cam surface which is in the form of a groove 80 formed in a flat surface 82 of the rotating cam body 44 and in which is positioned the cam follower 48. The cam follower 48 is thus captive within the groove 80 and must follow the contour of the cam surfaces 46 which really are the radially inner and outer sidewalls defining the sides for the groove 80. Herein, the cam body 44 is fixedly mounted to a central horizontal drive shaft 31 which is the output shaft of the speed reducer 28. The cam body is mounted for rotation by a bearing 84 mounted on the shaft 31.

Herein, the cam groove surface 46 is precisely computed and curved to provide displacements and inertias to provide for faster acceleration and slower and longer decelerations of the screen printing carriage 14 before it reverses its direction of travel. It will be appreciated that as the cylinder 17 oscillates and reverses its direction of travel it must come to a complete stop in its one direction of rotation before accelerating to travel in the opposite direction of rotation. The masses for larger sizes of cylinders are quite large and for high speed printing the velocities reached may be quite high. The momentum or inertia of these cylinders and connected printing carriages traveling at high speed may be quite large because inertia includes the factor of the velocity being squared. With the present invention, the maximum inertia loads are calculated so as not to exceed a predetermined maximum inertia load and the displacement of the cylinder relative to time is also calculated and the profiled cam surface 46 is generated to limit the maximum inertia and to provide a much slower cylinder stopping movement over a longer period of time than with the usual crank or single symmetrical cam of the conventional drives. The conventional displacement of the cylinder may be visualized by viewing the curve 86 in FIG. 3 which shows a vertical displacement plotted against a horizontal time scale. The curve 86 shows a harmonic with the maximum velocity occurring midway in time at the point **86*c*. The initial acceleration of the cylinder is illustrated by the slope of the curve section 86*b* which is symmetrical with the deceleration curve section 86*a* when the cylinder begins to decelerate before it stops travel in a first direction at point 86*f***.

With the present invention, the acceleration is much quicker and over a shorter time period as shown by the steeper slope of the curve section **85*b* relative to the slope of the curve section 86*b* for a crank or conventional symmetrical cam. As will be explained the preferred movement includes a movement which, as the gear segment 36 brings the cylinder 17 to its end of travel in one direction is like that of a modified sine wave which has a very long time and flat characteristic as shown by the a curve section 85*a* on a solid line curve 85. Thus, the non-symmetrical cam surface 46 provides a shorter period of time to accelerate the cylinder 17 from the beginning print position, which is shown by the faster and sharper slope section 85*b* on the curve 85 relative to the conventional harmonic curve section 86*b* shown in dotted lines for a crank or the conventional cam of symmetrical proportions used in prior art. Also, with a conventional symmetrical cam or crank, the maximum velocity at point 86*c* on the curve 86 occurs later in time than the corresponding maximum acceleration point 85*c* for the curve 85. Because a substantially shorter period of time is used for acceleration to the maximum velocity at the point 85*c* when using the profiled cam 46 of this invention, there is a very substantially longer period of time remaining for the deceleration. It will be seen that the central portion or point 86c is displaced from the center or highest point 85c by a time displacement of approximately twenty percent or more which means that there will be at least an additional twenty percent more time for deceleration. By profiling the cam surface 46 appropriately the cylinder 17 can be decelerated more slowly as shown by the flattened slope curve section 85a**.

In accordance with an important aspect of the present invention, the maximum momentum forces is calculated and is limited by changing the various variables so that the system is not overloaded so as not to cause failure due to very high inertia loads being applied, particularly during the stopping motion. The maximum inertia used with the present invention is substantially lower than a similar crank operation as shown by the height of the respective curves 85 and 86. Also, because the maximum velocity is decreased with the captive and profiled cam of this invention versus the maximum velocity obtained with the conventional crank, there is less horsepower used to drive the printing means, horsepower being a function of velocity. Also, as will be explained, the impact force or the change in force is also carefully controlled to be more evenly controlled at various parts of the drive cycle as compared to a crank system where the changes in force may be quite large, as will be explained below.

Figure 3:
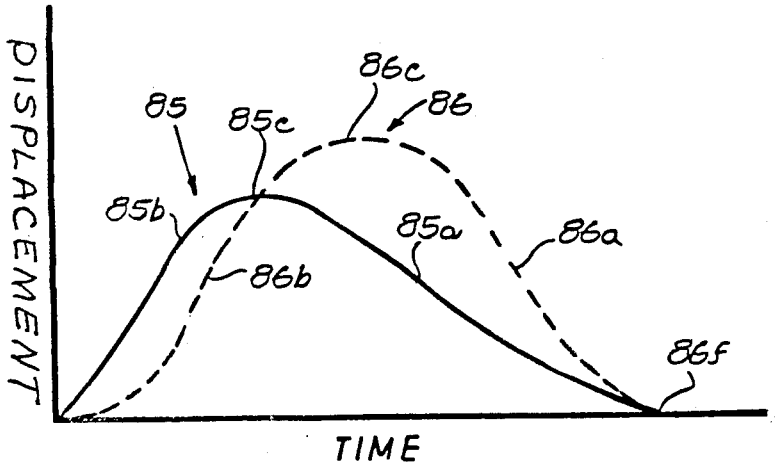
FIG. 3 is a diagrammatic view illustrating the differences in velocity and time relationships between a crank drive mechanism and the profiled controlled cam of the present invention.
Figure 4:
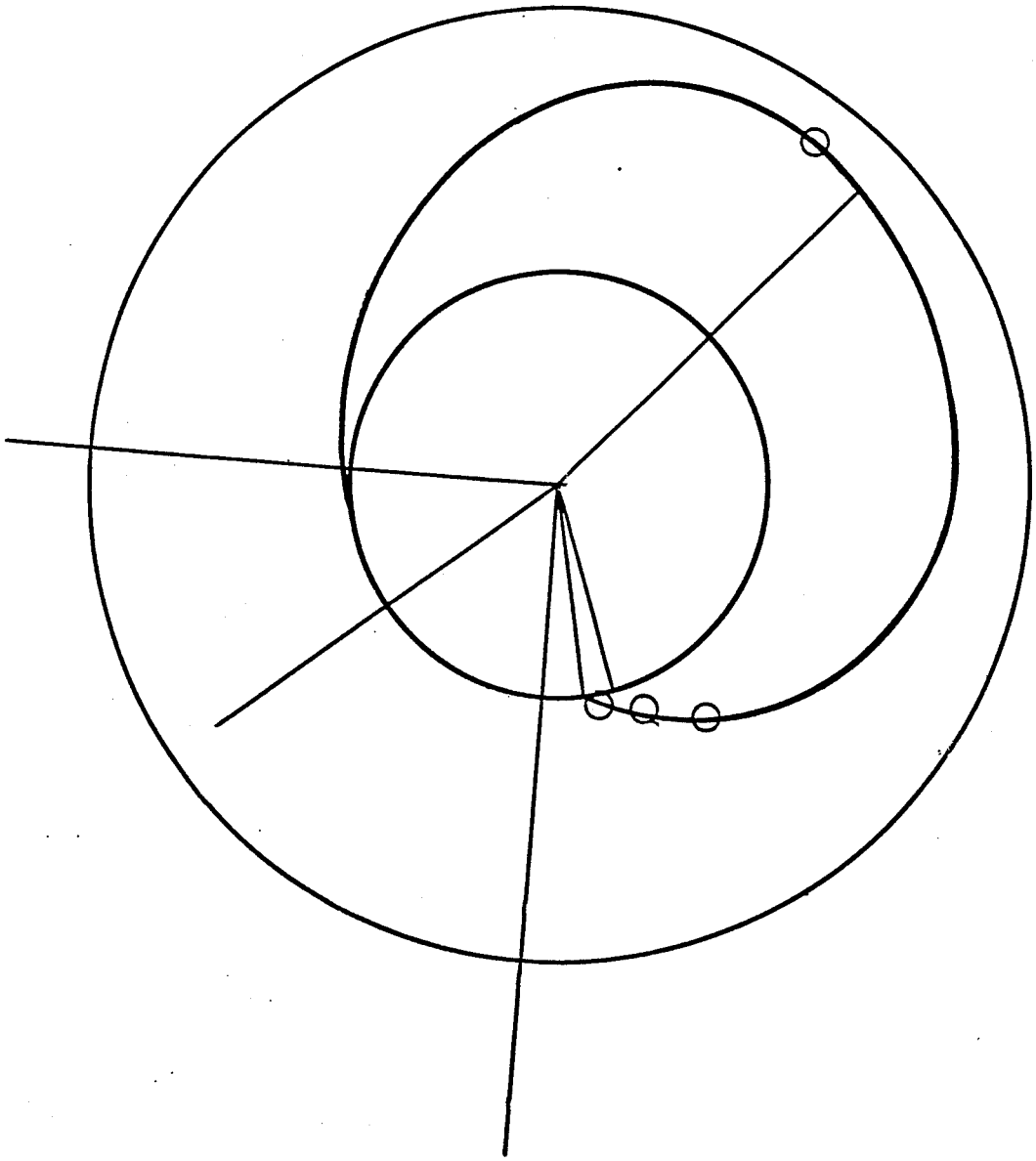
FIG. 4 is a diagrammatic view of a cam having a cam profile groove constructed in accordance with Exhibit A, Table I.

There is illustrated in FIG. 4, a sample of the groove profile cam groove 80 which is plotted for a cam having a weight of fifty pounds and a specific cycling speed. Exhibit A shows a specific printout for the forces generated by one profiled cam to drive a screen printing press. By way of explanation, the press has a specific distance of 8.244001 inches from the pivot center of the pivot pin 40 to the center of the cam follower ball 48 and the first lever length measured between the pivot pin 40 and the center of the pivot pin 34 for the push rod is 16.25 inches. The horizontal distance between the first lever pivot and the centerline of the cam shaft 31 is 6 inches and the vertical distance between the pivot pin 40 and the cam shaft 31 is 7.75 inches. In Table I, the amount of rotation is shown per degree and X and Y displacements. The "Curve" dimension and radius define points to be cut to define the profiled curve for the profiled cam surface. The "HP" designations indicate the horsepower being used and indicate the amount of maximum power that is needed to generated by the cam drive motor 26. Because velocity is a factor in the formula for horsepower, the HP column also gives an indication of velocity at each degree of rotation. The "Force" column lists the impact force for each degree of rotation. It is important to analyze the "Force" column to assure that the maximum velocities and forces are not too high and also to analyze that the change in force is relatively uniform. For instance, when initially accelerating the lever means 21 and the printing means 12, the last column in Table I shows an incremental change in Force of 22 pounds after an initial eighteen pounds from position 1 to position 2. Near the end of the deceleration, the force change in 140°–144° of rotation is in less than two pound increments and this at the end of the slope 86a shown in FIG. 3. Positions 145 and 146 are at points 85f on the curve 85 of FIG. 3 and at this stopping point the force is nearly zero and the horsepower is nearly zero. The horsepower is not really at zero when the cylinder is rotating, but at very low horsepowers, the computer is programmed to print out a zero. A second curve similar to the curve 85 is again generated for the printing means as is it is moved in the reverse direction at point 147 with force increasing by 15 and then by increasing additional 17 pound increments. In the reverse direction of travel starting at position 147, there is an initial acceleration up the curve section 145b to the maximum force of 182.18 at position 162. The deceleration with zero horsepower at the bottom of the curve 85a occurs over positions 281–299.

TABLE I

EXHIBIT A,

CAM REPORT DATE: 08-04-1988
CYCLOID CAM
PART NUMBER # 1733021 GRPPR DRIVE CAM W/BED LIFT CYCLING SPEED: 1500 WEIGHT: 50
MAXIMUM DEVIATION 7.884 GOING UP CONSTANT VEL. DISTANCE .05
GOING DOWN CONSTANT VEL DISTANCE .05
RATIO START UP/FINISH UP CYCLOID .25
RATIO START DOWN/FINISH DOWN CYCLOID .25
MXIMUM DEVIATION 7.884 PIVOT TO BALL 8.244001 LEVER LENGTH 16.25
START UP 0 ALL UP = 145 START DOWN = 155 ALL DOWN = 309 CRANK POSITION = 0
HORIZ DIST LEVER PIVOT TO CAMSHAFT = 6 VERT DIST PIVOT TO SHAFT = 7.75
BEARING DIAMETER = 1.25 TANGENT OF PRESS. ANGLE .7100001

| | | | | | | |
|---|---|---|---|---|---|---|
| 1 ROTATION = 1 | X = 3.9994 | Y = .0698 | CURVE = −4.0036 | RADIUS = 4.000054 | HP = 0 | FORCE = 3.71 |
| 2 ROTATION = 2 | X = 3.9979 | Y = .1396 | CURVE = −4.2825 | RADIUS = 4.000432 | HP = 0 | FORCE = 22.33 |
| 3 ROTATION = 3.003 | X = 3.9959 | Y = .2096 | CURVE = 9.2186 | RADIUS = 4.001454 | HP = 0 | FORCE = 44.33 |
| 4 ROTATION = 4.008 | X = 3.9936 | Y = .2798 | CURVE = 15.6839 | RADIUS = 4.003431 | HP = 0 | FORCE = 65.8 |
| 5 ROTATION = 5.017 | X = 3.9913 | Y = .3504 | CURVE = 414.3306 | RADIUS = 4.006667 | HP = 0 | FORCE = 86.62 |
| 6 ROTATION = 6.03 | X = 3.9892 | Y = .4214 | CURVE = −20.3466 | RADIUS = 4.011445 | HP = .001 | FORCE = 106.26 |
| 7 ROTATION = 7.047 | X = 3.9876 | Y = .4929 | CURVE = −9.349399 | RADIUS = 4.018036 | HP = .003 | FORCE = 124.78 |
| 8 ROTATION = 8.069 | X = 3.9868 | Y = .5652 | CURVE = −6.9759 | RADIUS = 4.026684 | HP = .006 | FORCE = 141.73 |
| 9 ROTATION = 9.097999 | X = 3.9868 | Y = .6384 | CURVE = −6.7782 | RADIUS = 4.037613 | HP = .01 | FORCE = 157.03 |
| 10 ROTATION = 10.132 | X = 3.9878 | Y = .7126 | CURVE = 5.3369 | RADIUS = 4.051018 | HP = .015 | FORCE = 170.56 |
| 11 ROTATION = 11.172 | X = 3.9899 | Y = .788 | CURVE = 4.9726 | RADIUS = 4.067065 | HP = .022 | FORCE = 181.95 |
| 12 ROTATION = 12.217 | X = 3.9933 | Y = .8647 | CURVE = 4.8208 | RADIUS = 4.08589 | HP = .03 | FORCE = 191.28 |
| 13 ROTATION = 13.269 | X = 3.9979 | Y = .9428 | CURVE = 5.4255 | RADIUS = 4.107595 | HP = .04 | FORCE = 198.31 |
| 14 ROTATION = 14.326 | X = 4.0037 | Y = 1.0225 | CURVE = 5.6491 | RADIUS = 4.132248 | HP = .052 | FORCE = 203.03 |
| 15 ROTATION = 15.388 | X = 4.0107 | Y = 1.1038 | CURVE = 6.0713 | RADIUS = 4.159883 | HP = .066 | FORCE = 205.33 |
| 16 ROTATION = 16.454 | X = 4.0188 | Y = 1.1869 | CURVE = 7.0907 | RADIUS = 4.190498 | HP = .081 | FORCE = 205.23 |
| 17 ROTATION = 17.523 | X = 4.028 | Y = 1.2718 | CURVE = 8.2937 | RADIUS = 4.224056 | HP = .097 | FORCE = 202.67 |
| 18 ROTATION = 18.595 | X = 4.038 | Y = 1.3585 | CURVE = 12.0065 | RADIUS = 4.260485 | HP = .115 | FORCE = 197.78 |
| 19 ROTATION = 19.668 | X = 4.0488 | Y = 1.4471 | CURVE = 15.0382 | RADIUS = 4.299681 | HP = .133 | FORCE = 190.49 |
| 20 ROTATION = 20.742 | X = 4.06 | Y = 1.5376 | CURVE = 33.4357 | RADIUS = 4.341506 | HP = .151 | FORCE = 181.03 |
| 21 ROTATION = 21.816 | X = 4.0716 | Y = 1.6299 | CURVE = 53.2765 | RADIUS = 4.38579 | HP = .17 | FORCE = 169.31 |

TABLE I-continued

EXHIBIT A.

CAM REPORT DATE: 08-04-1988
CYCLOID CAM
PART NUMBER # 1733021 GRPPR DRIVE CAM W/BED LIFT CYCLING SPEED: 1500 WEIGHT: 50
MAXIMUM DEVIATION 7.884 GOING UP CONSTANT VEL. DISTANCE .05
GOING DOWN CONSTANT VEL DISTANCE .05
RATIO START UP/FINISH UP CYCLOID .25
RATIO START DOWN/FINISH DOWN CYCLOID .25
MXIMUM DEVIATION 7.884 PIVOT TO BALL 8.244001 LEVER LENGTH 16.25
START UP 0 ALL UP = 145 START DOWN = 155 ALL DOWN = 309 CRANK POSITION = 0
HORIZ DIST LEVER PIVOT TO CAMSHAFT = 6 VERT DIST PIVOT TO SHAFT = 7.75
BEARING DIAMETER = 1.25 TANGENT OF PRESS. ANGLE .7100001

| | | | | | | |
|---|---|---|---|---|---|---|
| 22 ROTATION = 22.889 | X = 4.0833 | Y = 1.7239 | CURVE = −55.1839 | RADIUS = 4.432335 | HP = .187 | FORCE = 155.75 |
| 23 ROTATION = 23.959 | X = 4.0948 | Y = 1.8196 | CURVE = −21.2033 | RADIUS = 4.480916 | HP = .204 | FORCE = 140.25 |
| 24 ROTATION = 25.027 | X = 4.1058 | Y = 1.9169 | CURVE = −14.4374 | RADIUS = 4.531285 | HP = .22 | FORCE = 123.07 |
| 25 ROTATION = 26.091 | X = 4.1161 | Y = 2.0156 | CURVE = −11.3946 | RADIUS = 4.583172 | HP = .233 | FORCE = 104.55 |
| 26 ROTATION = 27.15 | X = 4.1254 | Y = 2.1156 | CURVE = −8.727101 | RADIUS = 4.636289 | HP = .244 | FORCE = 84.72 |
| 27 ROTATION = 28.205 | X = 4.1333 | Y = 2.2168 | CURVE = −7.1736 | RADIUS = 4.690334 | HP = .253 | FORCE = 63.87 |
| 28 ROTATION = 29.255 | X = 4.1397 | Y = 2.3189 | CURVE = −6.5407 | RADIUS = 4.744993 | HP = .259 | FORCE = 42.32 |
| 29 ROTATION = 30.3 | X = 4.1442 | Y = 2.4217 | CURVE = −5.3794 | RADIUS = 4.799947 | HP = .261 | FORCE = 20.26 |
| 30 ROTATION = 31.34 | X = 4.1465 | Y = 2.5251 | CURVE = −4.9241 | RADIUS = 4.854938 | HP = .262 | FORCE = 2.59 |
| 31 ROTATION = 32.374 | X = 4.1467 | Y = 2.6289 | CURVE = −5.061 | RADIUS = 4.909918 | HP = .262 | FORCE = .78 |
| 32 ROTATION = 33.403 | X = 4.1447 | Y = 2.7333 | CURVE = 6.4376 | RADIUS = 4.964865 | HP = .261 | FORCE = 2.29 |
| 33 ROTATION = 34.427 | X = 4.1404 | Y = 2.838 | CURVE = 4.89 | RADIUS = 5.019758 | HP = .261 | FORCE = 3.61 |
| 34 ROTATION = 35.447 | X = 4.1339 | Y = 2.943 | CURVE = 5.0575 | RADIUS = 5.074578 | HP = .26 | FORCE = 5.15 |
| 35 ROTATION = 36.462 | X = 4.1252 | Y = 3.0483 | CURVE = 4.9473 | RADIUS = 5.129304 | HP = .259 | FORCE = 6.37 |
| 36 ROTATION = 37.473 | X = 4.1141 | Y = 3.1538 | CURVE = 4.7906 | RADIUS = 5.183917 | HP = .258 | FORCE = 7.81 |

Figure 2:
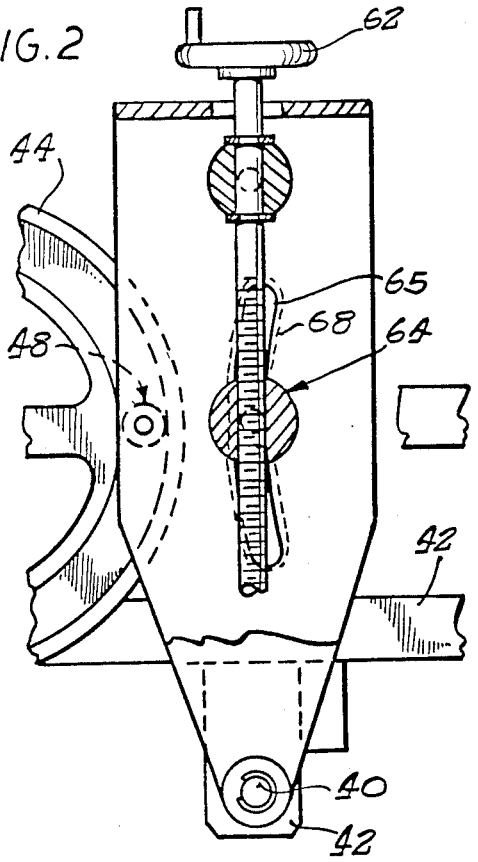
FIG. 2 is an exploded view of the apparatus of FIG. 1.
Figure 2A:
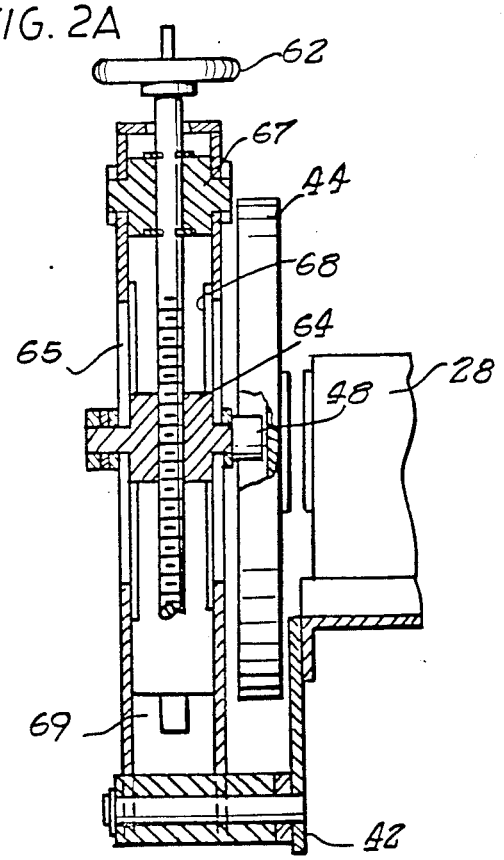
FIG. 2A is a cross-sectional view of the first lever shown in FIG. 2.

Thus, it will be seen that force applied to accelerate the printing carriage rises quickly from 15 position 1 in Table I to a maximum of 205.33 at position 15 which is on the curve section **85*b* on the curve 85 of FIG. 3 and then declines from position 15 to position 145 at which the force is zero. It should be noted that the horsepower (HP) is reduced to zero as early as position 128 and remains at zero through position 151 and that horsepower begins to be seen again at position 152 when the carriage is beginning to travel in the opposite direction. At positions 145 and 146, the printing carriage will be reversing direction and at position 300 the carriage will be reversing its direction of travel again. FIG. 4 illustrates an actual cam printout corresponding to the data in Table I. The cam profile in FIGS. 1–3 is merely representative whereas cam profile of FIG. 4** is an actual cam profile used on existing printing press.

A brief description of the invention will be given illustrating th preferred embodiment of the invention. When the motor 26 is energized and the cam means 23 is beginning to be driven toward its beginning print position. The cam 44 turns and the cam surfaces 46 push the cam follower 48 to accelerate the cylinder 17 and the screen printing carriage quickly towards its maximum velocity, this being the fast rise along the slope **85*b*. Whereupon the acceleration will begin because of the curvature of the slot in the cam which causes the cylinder to be turned rapidly toward the beginning print position which is to the right, as viewed in FIG. 1, and after about thirty percent of its movement to the right, the acceleration will begin to decelerate from the point 85*c* on the curve 85, and then the deceleration continues for the remaining seventy percent of the travel to the right towards the beginning print position. The deceleration can be seen in the Table and is particularly indicated by the slower, more generally curved slope 85*a* which shows that there is substantially less displacement with time on the curve 85*a* than on the corresponding portion of the curve 86*a*** which represent the deceleration in time of a typical crank having a harmonic motion. In the harmonic crank motion, it will be seen that only about fifty percent of the time is used for deceleration and the deceleration is much faster with higher inertias. Because inertia is dependent upon the velocity squared, and because with this invention slower velocities are now occurring at the end of the travel in one direction, there is a significant lessening of the inertias to be overcome to stop the cylinder and printing carriage and to reverse their travel directions.

From the foregoing, it will be seen there has been provided a new and improved drive for a screen printing press and more particularly, the drive which has controlled inertia characteristics differing from that of the prior art drives. The preferred deceleration is by means of a profiled cam characteristic which has a very long deceleration time for the cylinder before a reversal of the direction of rotating travel so that there will be less banging or jarring motions. The present invention also provides a quick and easy manner in which the stroke can be adjusted so that it can be sized to the particular area of the web being printed. The stroke is adjusted at the end of the print direction travel and the beginning print stroke always remains at the same position.

A preferred embodiment has been shown and described, and it will be understood that there is no intent to limit the invention by such disclosure; but, rather, it is intended to cover all modifications and alternate constructions falling within the scope of the invention as defined in the appended claims.

What is claimed is:

1. In a screen printing cylinder press for screen printing on a sheet, the combination comprising:

a cylinder mounted for rotating in the press and having a gripper thereon to grip a sheet, a screen printing means including a movable screen printing carriage for screen printing on the sheet, connecting means connected to the cylinder to oscillate the same through a stroke of a given length, and a cam means having a predetermined profile cam surface and a cam follower for following the cam surface and connected to the connecting means to actuate the latter to turn the cylinder and to reciprocate this screen printing means, said cam profile surface providing a displacement and velocity curve characteristic to turn the cylinder to its maximum rotational velocity in less than fifty percent of the turning time in each direction and for decelerating the cylinder over a time period greater than fifty percent of rotating travel time in each direction.

2. An apparatus in accordance with claim 1 in which the cam means includes a groove and in which the cam follower is a captive follower in said groove.

3. In a screen printing cylinder press for printing on a sheet, the combination comprising:

a cylinder in the press having a gripper for gripping the sheet with sheet disposed on the periphery of the cylinder during printing, a screen printing means including a movable screen printing carriage;

a lever means connected to the cylinder to oscillate the same through a stroke of a given length and to reciprocate the carriage, cam actuating means to actuate the lever means through an oscillatory path to oscillate the cylinder, adjustable stroke means in said lever means for adjusting the stroke of the lever means from said given length of stroke, thereby changing oscillation stroke of the cylinder, a lever in said lever means having an adjustable pivotal connection, and a screw drive in the adjustable stroke means to shift the pivotal connection to adjust the amount of oscillation of the cylinder and thereby the stroke of cylinder.

4. A screen printing press in accordance with claim 3 in which said lever means comprises a first lever and a gear segment and a link pivotally connected between the first lever and the gear segment, said screw drive being mounted on said first lever, said pivotal connection joining said link to said first lever, and said screw drive shifting the pivotal connection along said first one lever.

5. A screen printing press in accordance with claim 4 in which a manual handle is provided to turn said screw drive and to shift the position of the pivotal connection.

6. A screen printing press in accordance with claim 4 in which said lever means includes a first lever having a groove therein in which moves the pivotal connection to change its position with respect to a pivotal axis for the first lever with turning of the screw drive.

* * * * *

UNITED STATES PATENT AND TRADEMARK OFFICE

CERTIFICATE OF CORRECTION

PATENT NO. : 4,958,559

DATED : September 25, 1990

INVENTOR(S) : Bubley, et al.

It is certified that error appears in the above-identified patent and that said Letters Patent is hereby corrected as shown below:

Column 1, Line 16, after "cylinder" insert --.--.

Column 1, Line 25, after "carriage" insert --.--.

Column 1, Line 31, after "to" (second occurrence) insert --a--.

Column 2, Line 12, delete "taken".

Column 2, Line 32, after "printed" insert --is--.

Column 2, Line 40, change "bear" to --bar--.

Column 4, Line 53, delete "a" (first occurrence).

Column 6, Line 9, after "to" insert --be--.

Column 6, Line 31, delete "is" (first occurrence).

Column 7, Line 27, delete "15".

Column 7, Line 44, change "th" to --the--.

Column 8, Line 33, after "seen" insert --that--.

Column 6, Line 41, after "Exhibit A" delete ",".

Column 5, Line 60, Place rotation number on line with "9 Rotation = 9.097999".

UNITED STATES PATENT AND TRADEMARK OFFICE

CERTIFICATE OF CORRECTION

PATENT NO. : 4,958,559

DATED : September 25, 1990

INVENTOR(S) : Bubley, et al

It is certified that error appears in the above-identified patent and that said Letters Patent is hereby corrected as shown below:

Column 8, Line 25, insert pages 2, 3, 4 and 5 of the tables.

Signed and Sealed this

Fifth Day of May, 1992

*Attest:*

DOUGLAS B. COMER

*Attesting Officer*

*Acting Commissioner of Patents and Trademarks*